US006324981B1

(12) United States Patent
Siegler et al.

(10) Patent No.: US 6,324,981 B1
(45) Date of Patent: Dec. 4, 2001

(54) PYROTECHNIC PROJECTILE FOR PRODUCING CONTINUOUS PATTERNS IN THE SKY

(75) Inventors: Jean Pierre Siegler, Monteux; Badava Camara, Pernes les Fontaines, both of (FR)

(73) Assignee: Etienne Lacroix Tous Artifices S.A., Muret (FR)

( * ) Notice: Subject to any disclaimer, the term of this patent is extended or adjusted under 35 U.S.C. 154(b) by 0 days.

(21) Appl. No.: 09/445,848

(22) PCT Filed: Jun. 16, 1998

(86) PCT No.: PCT/FR98/01261

§ 371 Date: Feb. 24, 2000

§ 102(e) Date: Feb. 24, 2000

(87) PCT Pub. No.: WO98/58225

PCT Pub. Date: Dec. 23, 1998

(30) Foreign Application Priority Data

Jun. 16, 1997 (FR) ..... 97 07442

(51) Int. Cl.[7] ..... F42B 4/04
(52) U.S. Cl. ..... 102/361; 102/336; 102/351
(58) Field of Search ..... 102/336, 351, 102/361

(56) References Cited

U.S. PATENT DOCUMENTS

| | | | | |
|---|---|---|---|---|
| 282,891 | * | 8/1883 | Hirayama | 102/361 X |
| 2,402,968 | * | 7/1946 | MacMillan et al. | 102/336 |
| 3,557,698 | | 1/1971 | Hart et al. | 102/6 |
| 3,951,066 | | 4/1976 | Schroeder | 102/65 |
| 3,967,553 | | 7/1976 | Keraus et al. | 102/66 |
| 4,406,227 | * | 9/1983 | Beeker et al. | 102/505 |
| 5,025,729 | * | 6/1991 | Cameron | 102/336 |
| 5,423,264 | | 6/1995 | Siegler et al. | 102/342 |
| 5,574,248 | | 11/1996 | Brown et al. | 149/19.3 |
| 5,627,338 | * | 5/1997 | Poor et al. | 102/361 |
| 6,244,185 | * | 6/2001 | Yip | 102/352 |

FOREIGN PATENT DOCUMENTS

| | | | |
|---|---|---|---|
| 34 02 121 | | 7/1987 | (DE) . |
| 33 41 052 | | 3/1992 | (DE) . |
| 2 712 682 | | 5/1995 | (FR) . |
| 614305 | | 12/1948 | (GB) . |
| 2226944 | | 11/1993 | (GB) . |
| 54369 | * | 8/1966 | (JP) ..... 102/361 |

* cited by examiner

*Primary Examiner*—Peter A. Nelson
(74) *Attorney, Agent, or Firm*—Sughrue, Mion, Zinn, Macpeak & Seas, PLLC

(57) ABSTRACT

The invention concerns a pyrotechnic projectile comprising a body containing a bursting charge (4) and a combustible charge (5) which is ignited and dispersed by the bursting charge (4), characterized in that the combustible charge (5) is formed by a metallic powder combustible with oxygen, arranged in the busting charge (4) according to a pattern corresponding of the flare pattern to be obtained in the sky. The metallic powder can be titanium, aluminum or magnesium powder.

6 Claims, 2 Drawing Sheets

PYROTECHNIC PROJECTILE FOR PRODUCING CONTINUOUS PATTERNS IN THE SKY

The present invention relates to pyrotechnic projectiles intended to obtain figures, letters or any pattern in the sky using pyrotechnic means.

Bombs which depict patterns have been widely known for some years in the world of pyrotechnics and that of fireworks in particular.

The most common of these patterns is the circle, but other patterns such as triangles, several circles, figures or other shapes are also possible.

The method used to produce these patterns consists in storing stars in a bomb body in the same arrangement as the pattern itself.

These stars are agglomerates made from a pyrotechnic composition which burns with a flame colour that is characteristic of the formulation used.

When the bomb explodes, the stars are ignited and dispersed in the atmosphere and represent the desired pattern as several spots of light, each spot being made by a star.

To produce a pattern of continuous outline, it is necessary to use very small-sized stars so that a great many of them can be introduced into the bomb.

This solution is practically impossible to achieve because it becomes very difficult to ignite them. Furthermore, if it were possible, the burn time would be so short that the pattern would, mostly, escape the notice of the spectators.

The invention sets out to overcome the drawbacks of the known art by creating a pyrotechnic projectile which is capable of producing a pattern of continuous outline in the sky which is visible for long enough to be seen by the spectators.

Its subject is therefore a pyrotechnic projectile comprising a body containing a bursting charge and a combustible charge which is ignited and dispersed by exploding the bursting charge, characterized in that the combustible charge is formed of a metallic powder capable of combusting with oxygen from the air, this powder being arranged within the bursting charge in a pattern which corresponds to the shape of the firework pattern that is to be obtained in the sky.

The invention will be better understood with the aid of the description which will follow, which is given merely by way of example and made with reference to the drawings, in which.

Figure 2:
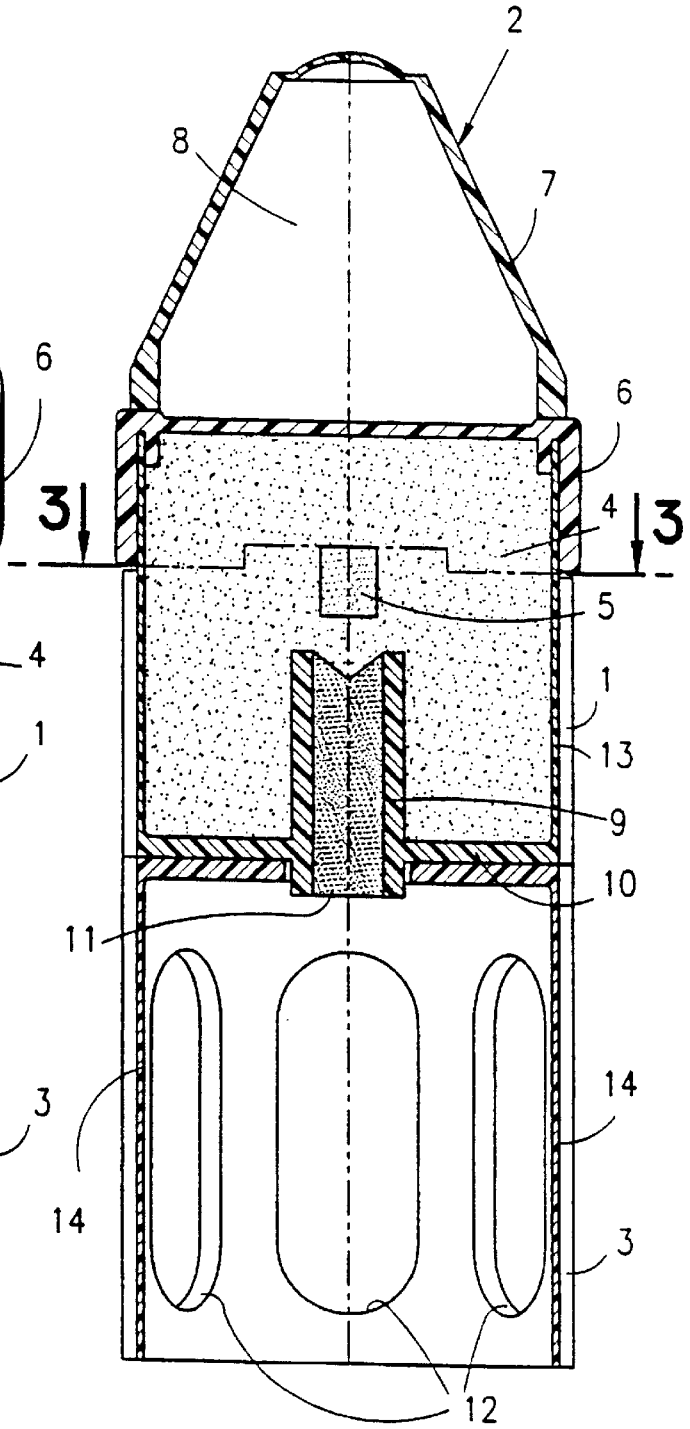
FIG. 2 is a view in axial section of the pyrotechnic projectile of FIG. 1.
Figure 3:
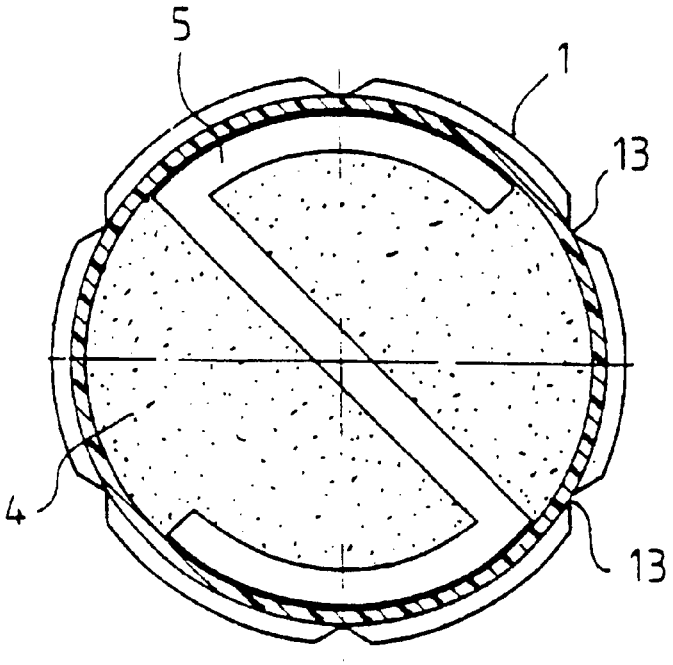
Figure 4:
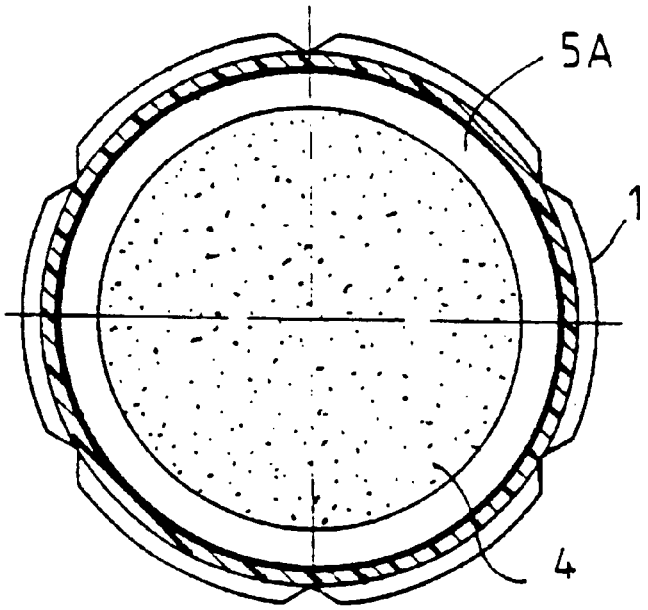

FIG. 3 is a view in section on a larger scale on the line 3—3 of FIG. 2, showing a combustible charge formed of agglomerated powdered metal arranged in the bursting charge and constituting a replica of the pattern that is to be obtained in the sky; and FIG. 4 is a view in section similar to that of FIG. 3, depicting a combustible charge formed of agglomerated metallic particles intended for obtaining another pattern in the sky.

Figure 1:
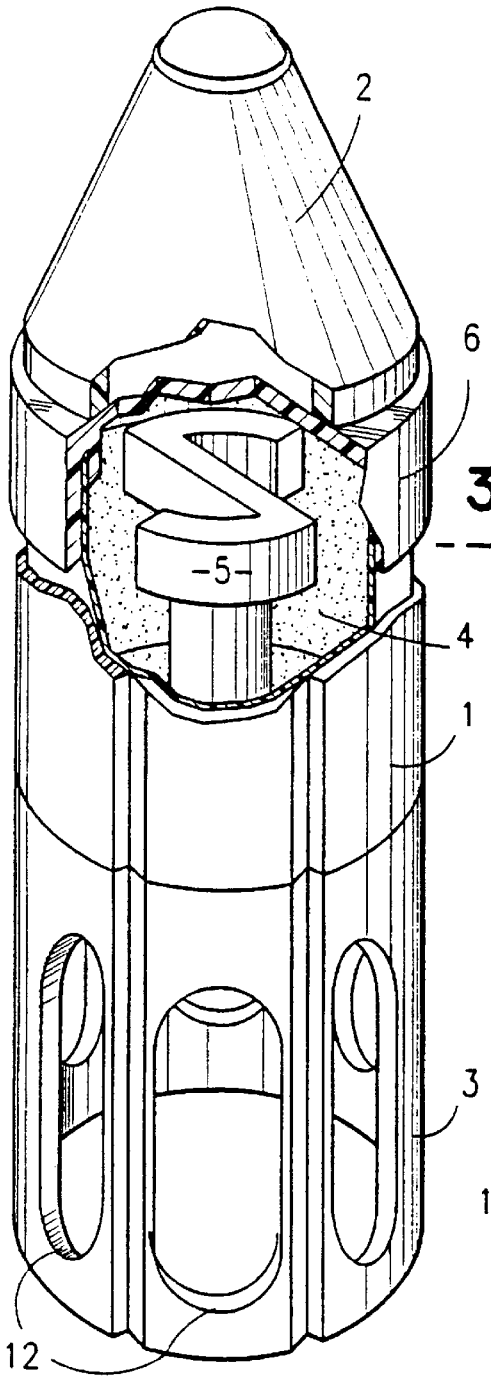
FIG. 1 is a view in perspective with partial cut-away of the pyrotechnic projectile according to the invention.

The pyrotechnic projectile depicted in FIG. 1 comprises a plastic body 1 comprising a head 2 and with which there is associated a skirt 3 which forms an empennage.

Housed inside the body 1 is a bursting charge 4 consisting, for example, of gunpowder, within which there is a combustible charge 5 which, in this example, is formed of agglomerated metal particles such as titanium.

The block 5 of agglomerated metallic particles has, as can be seen also in FIG. 3, a shape that corresponds to the shape of the firework pattern that is to be obtained in the sky.

In this particular instance, it is the stylized shape of the FIG. 2.

According to a preferred embodiment of the invention, it is titanium sponge powder with a particle size greater than 500 $\mu$, which is used as metallic powder.

It is, however, possible to use another metal such as aluminium, magnesium or any other compound with a metallic structure, provided the shape and size of these particles'give it the ability to burn with the oxygen in the air.

Incidentally, the metal particles, instead of being agglomerated, may be arranged within the bursting charge in the form of divided powder, forming a replica of the pattern that is to be obtained in the sky.

The number of particles present in 1 gram of metallic particles powder used is several thousand particles.

This is a substantial advantage over the method of the prior art, because the patterns obtained with stars are generally made up of a few tens of points, generally less than 50 points.

The body 1 is closed by a cover 6 on which is mounted a container 7 of frustoconical shape and which defines the head of the projectile.

Thus, the cover 6 forms the base of the container 7.

Placed inside the container 7 is a mass 8 of metallic powder with a high density, for example iron powder, intended to add weight to the head of the projectile and shift its centre of gravity forwards.

As depicted in FIG. 2, the body 1 comprises an axial tubular sleeve 9, formed integrally with its closed end 10 and in which a pyrotechnic delay composition 11 is located.

The sleeve 9 opens into the centre of the skirt 3 forming the empennage.

Elongate openings 12 are formed in the skirt 3 to keep the projectile on course once it has been launched.

The tubular body 1, the skirt 3, the cover 6 of the body 1 and the container 7 forming the tip of the projectile are made of plastic, for example polystyrene, and are joined together by adhesive bonding.

The skirt 3 is made in such a way as to be strong enough that it is not destroyed by the projectile launcher, but weak enough to be reduced, like the rest of the projectile casing, into small sized fragments when the projectile explodes.

The bursting charge 4 has three functions; it explodes the projectile and it disperses the titanium particles of the combustible charge 5. It also holds the pattern represented by the illuminating charge in position in the body 1.

The pyrotechnic delay is a delay of the order of 2 seconds which is ignited as the projectile launches and transmits the ignition flame to the inside of the body 1 of the projectile when the latter reaches the point on its trajectory at which it is to be burst.

Upon explosion of the bursting charge 4, ignited by the pyrotechnic delay 11, the plastic body 1, tip 2 and skirt 3 are destroyed, the agglomerated particles of the combustible charge are dispersed and the mass of iron powder 8 is dispersed and falls back to earth without presenting the slightest risk of damaging objects or injuring people.

The dispersion of the titanium particles of the combustible charge makes it possible to obtain in the sky the pattern of firework of which the agglomerated block of titanium particles contained in the pyrotechnic projectile is the exact replica.

The high number of particles compressed in the agglomerated block means that the pattern obtained in the sky is one which, as far as the spectator is concerned, has an apparently continuous contour.

It is also possible by virtue of the invention to obtain a depiction of patterns of any shape.

In FIG. 3, the pattern represented by the agglomerated block 5 is a stylized 2.

In FIG. 4, which is a section through the pyrotechnic projectile according to the invention similar to that of FIG. 3, but in which the agglomerated block consists of a circle 5*a*, this circle, once the pyrotechnic projectile which contains it has exploded,. allows a circle of corresponding shape to be obtained in the air.

What is claimed is:

1. Pyrotechnic projectile comprising a body containing a bursting charge (4) and a combustible charge (5) which is ignited and dispersed by exploding the bursting charge (4), characterized in that the combustible charge (5) is formed of a metallic powder capable of combusting with oxygen from the air, this powder being arranged within the bursting charge (4) in a pattern which corresponds to the shape of the firework pattern that is to be obtained in the sky.

2. Pyrotechnic projectile according to claim 1, characterized in that the combustible charge (5) is formed of a block of agglomerated metallic particles.

3. Pyrotechnic projectile according to claim 1, characterized in that the combustible charge is formed of divided metallic powder arranged within the bursting charge and forming a replica of the pattern that is to be obtained in the sky.

4. Pyrotechnic projectile according to claim 1, characterized in that the metallic powder is a titanium powder.

5. Pyrotechnic projectile according to claim 4, characterized in that the particle size of the titanium powder is greater than 500 $\mu$.

6. Pyrotechnic projectile according to claim 1, characterized in that the metallic powder is an aluminium or magnesium powder.

* * * * *